US006454658B1

(12) United States Patent
Drouin

(10) Patent No.: US 6,454,658 B1
(45) Date of Patent: Sep. 24, 2002

(54) ROCKING AND SPRAY SYSTEM

(76) Inventor: Michael A. Drouin, 16 B Old Center Rd., Deerfield, NH (US) 03037

( * ) Notice: Subject to any disclaimer, the term of this patent is extended or adjusted under 35 U.S.C. 154(b) by 0 days.

(21) Appl. No.: 09/904,758

(22) Filed: Jul. 13, 2001

(51) Int. Cl.[7] ..... A63G 11/00
(52) U.S. Cl. ..... 472/114; 472/109; 472/128
(58) Field of Search ..... 472/14, 25, 106, 472/114, 128, 108, 137, 109; 239/211, 18

(56) References Cited

U.S. PATENT DOCUMENTS 2,470,473 A 5/1949 Daellenbach
3,151,864 A 10/1964 Sandusky
3,231,269 A * 1/1966 Dalrymple, Jr. ..... 472/106
4,135,712 A * 1/1979 Fitzsimons ..... 472/113
4,763,895 A 8/1988 Tepper
5,441,454 A * 8/1995 Race ..... 114/363
5,462,284 A 10/1995 Felsenthal
5,741,188 A 4/1998 Levin et al.
D405,845 S 2/1999 Blythe

* cited by examiner

*Primary Examiner*—Kien T. Nguyen

(57) ABSTRACT

A rocking and spray system for promoting paired outdoor activity by and cooling for children. The rocking and spray system includes a substantially arcuate hollow cradle portion designed for resting on a support surface such as the ground and for rocking along an arcuate perimeter surface; a pair of seat portions coupled to the cradle portion and positioned adjacent to an associated one of a pair of ends of the cradle portion and designed for supporting a posterior of a human; and a water receiving portion designed for coupling to a conventional garden hose to facilitate routing of water to spray a user.

13 Claims, 3 Drawing Sheets

ROCKING AND SPRAY SYSTEM

BACKGROUND OF THE INVENTION

1. Field of the Invention

The present invention relates to children's water toys and more particularly pertains to a new rocking and spray system for promoting paired outdoor activity by and cooling for children.

2. Description of the Prior Art

The use of children's water toys is known in the prior art. More specifically, children's water toys heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,151,864; 4,763,895; 5,741,188; 5,462,284; 2,470,473; and Des. 405,845.

While these devices fulfill their respective, particular objectives and requirements, the aforementioned patents do not disclose a new rocking and spray system. The inventive device includes a substantially arcuate hollow cradle portion designed for resting on a support surface such as the ground and for rocking along an arcuate perimeter surface; a pair of seat portions coupled to the cradle portion and positioned adjacent to an associated one of a pair of ends of the cradle portion and designed for supporting a posterior of a human; and a water receiving portion designed for coupling to a conventional garden hose to facilitate routing of water to spray a user.

In these respects, the rocking and spray system according to the present invention substantially departs from the conventional concepts and designs of the prior art, and in so doing provides an apparatus primarily developed for the purpose of promoting paired outdoor activity by and cooling for children.

SUMMARY OF THE INVENTION

In view of the foregoing disadvantages inherent in the known types of children's water toys now present in the prior art, the present invention provides a new rocking and spray system construction wherein the same can be utilized for promoting paired outdoor activity by and cooling for children.

The general purpose of the present invention, which will be described subsequently in greater detail, is to provide a new rocking and spray system apparatus and method which has many of the advantages of the children's water toys mentioned heretofore and many novel features that result in a new rocking and spray system which is not anticipated, rendered obvious, suggested, or even implied by any of the prior art children's water toys, either alone or in any combination thereof.

To attain this, the present invention generally comprises a substantially arcuate hollow cradle portion designed for resting on a support surface such as the ground and for rocking along an arcuate perimeter surface; a pair of seat portions coupled to the cradle portion and positioned adjacent to an associated one of a pair of ends of the cradle portion and designed for supporting a posterior of a human; and a water receiving portion designed for coupling to a conventional garden hose to facilitate routing of water to spray a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rocking and spray system apparatus and method which has many of the advantages of the children's water toys mentioned heretofore and many novel features that result in a new rocking and spray system which is not anticipated, rendered obvious, suggested, or even implied by any of the prior art children's water toys, either alone or in any combination thereof.

It is another object of the present invention to provide a new rocking and spray system which may be easily and efficiently manufactured and marketed.

It is a further object of the present invention to provide a new rocking and spray system which is of a durable and reliable construction.

An even further object of the present invention is to provide a new rocking and spray system which is susceptible of a low cost of manufacture with regard to both materials and labor, and which accordingly is then susceptible of low prices of sale to the consuming public, thereby making such rocking and spray system economically available to the buying public.

Still yet another object of the present invention is to provide a new rocking and spray system which provides in the apparatuses and methods of the prior art some of the advantages thereof, while simultaneously overcoming some of the disadvantages normally associated therewith.

Still another object of the present invention is to provide a new rocking and spray system for promoting paired outdoor activity by and cooling for children.

Yet another object of the present invention is to provide a new rocking and spray system which includes a substantially arcuate hollow cradle portion designed for resting on a support surface such as the ground and for rocking along an arcuate perimeter surface; a pair of seat portions coupled to the cradle portion and positioned adjacent to an associated one of a pair of ends of the cradle portion and designed for supporting a posterior of a human; and a water receiving portion designed for coupling to a conventional garden hose to facilitate routing of water to spray a user.

Still yet another object of the present invention is to provide a new rocking and spray system that provides hours of entertainment for children.

Even still another object of the present invention is to provide a new rocking and spray system that provides an alternate form of exercise for children.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
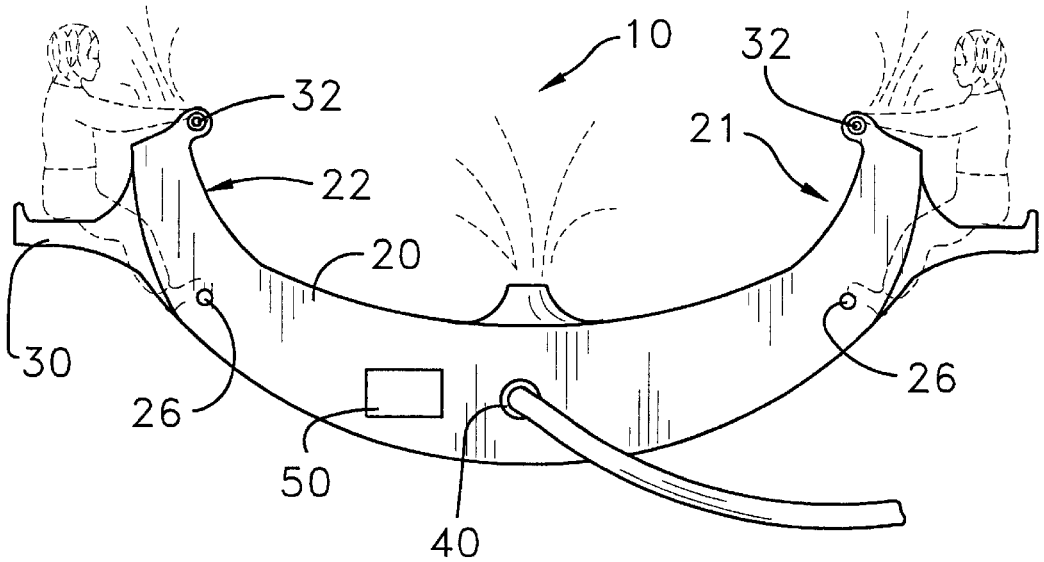
FIG. 1 is a schematic front view of a new rocking and spray system in use according to the present invention.
Figure 2:
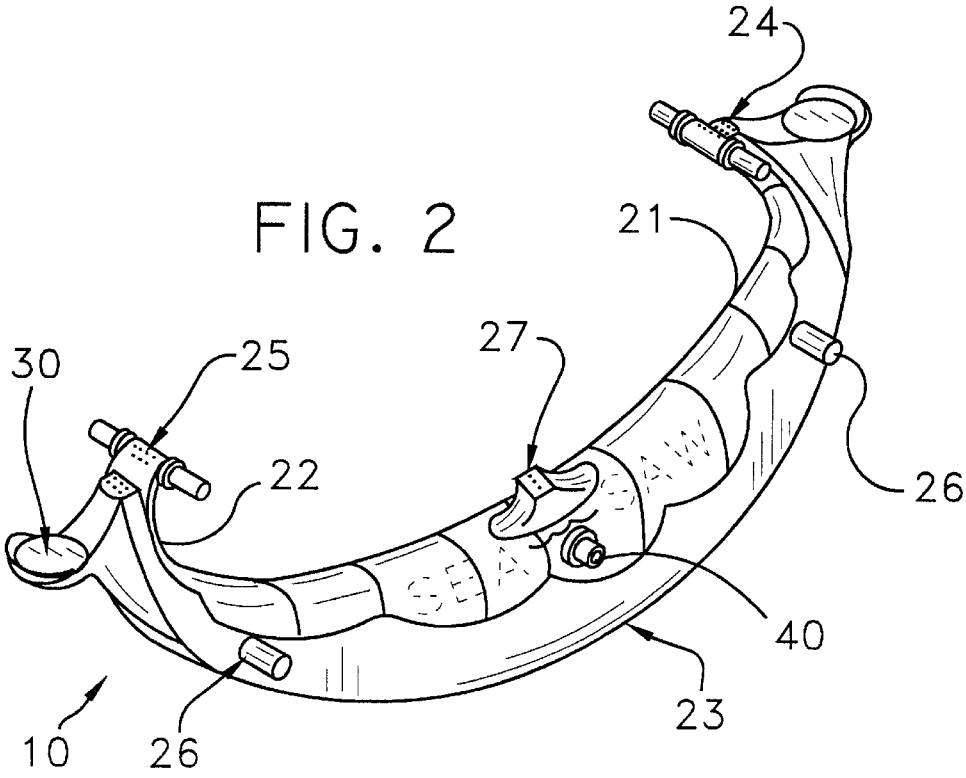
FIG. 2 is a schematic perspective view of the present invention.
Figure 3:
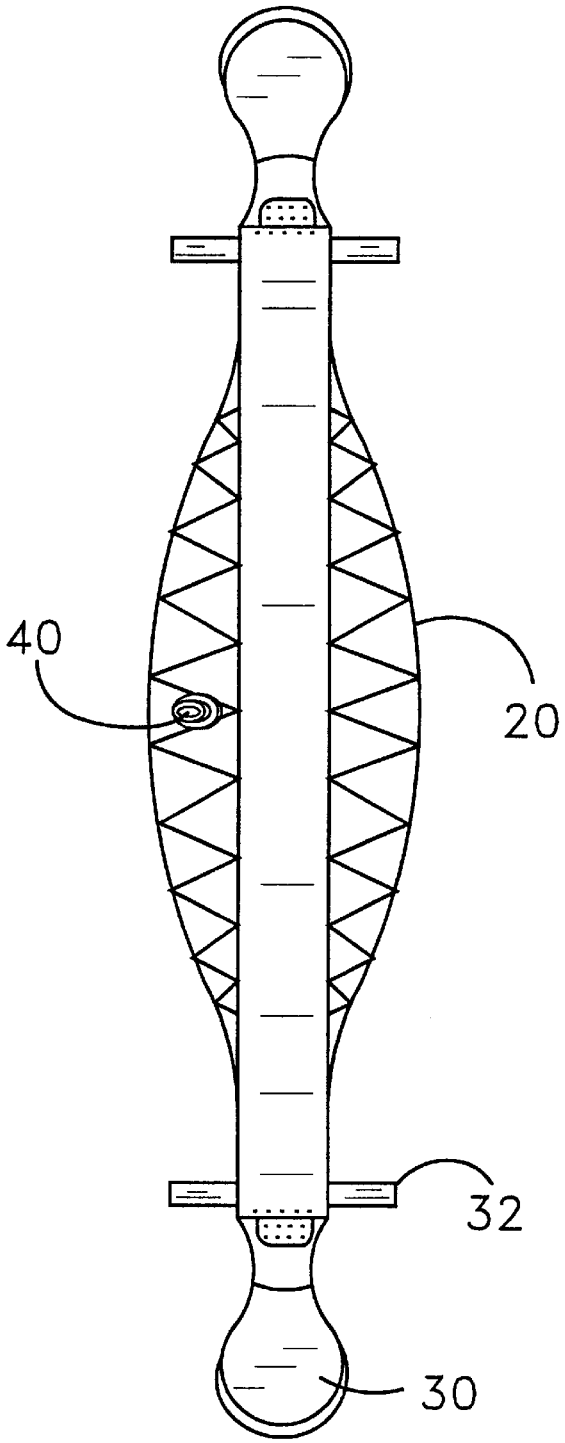
FIG. 3 is a schematic top view of the present invention.
Figure 4:
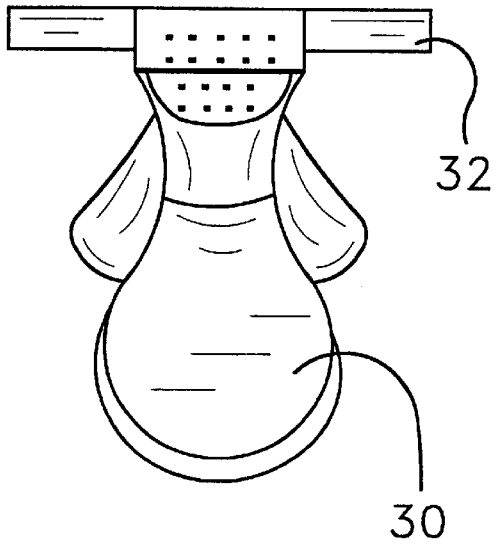
FIG. 4 is a schematic end view of the present invention.
Figure 5:
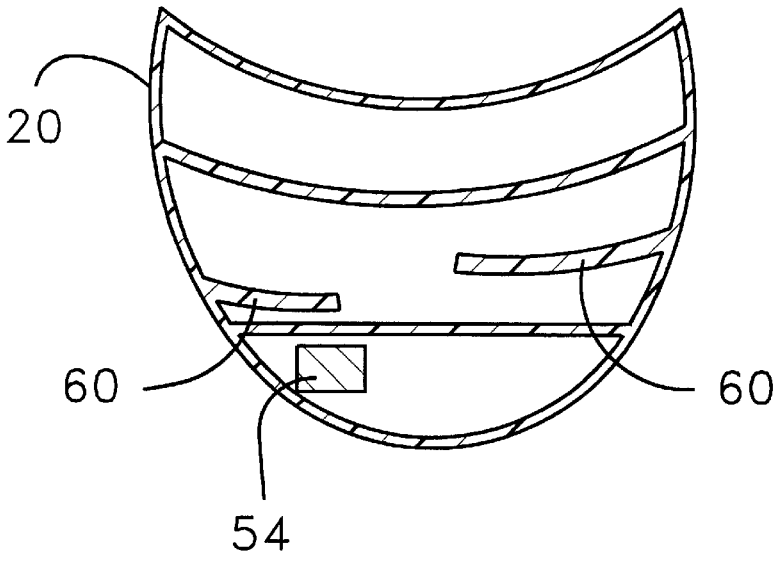
FIG. 5 is a schematic cross-sectional view of the baffles of the present invention.
Figure 6:
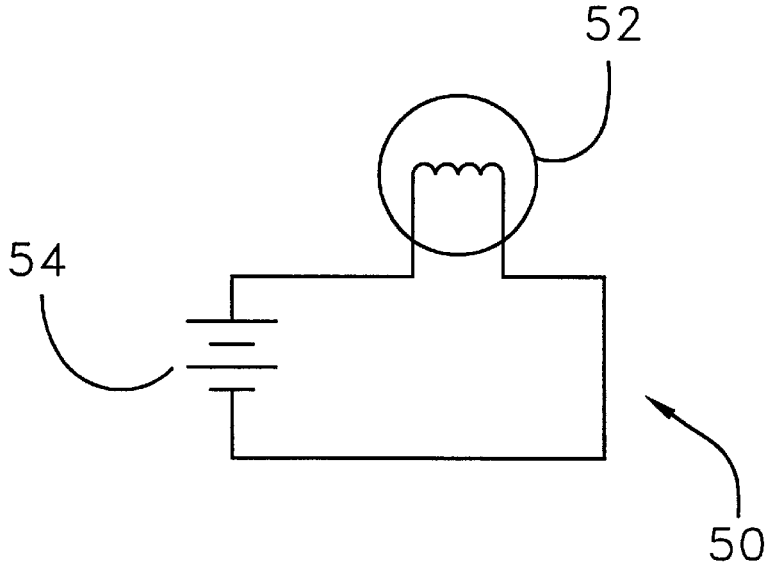
FIG. 6 is a schematic signal flow view of the illumination assembly of the present invention.

With reference now to the drawings, and in particular to FIGS. 1 through 6 thereof, a new rocking and spray system embodying the principles and concepts of the present invention and generally designated by the reference numeral 10 will be described.

As best illustrated in FIGS. 1 through 6, the rocking and spray system 10 generally comprises a cradle portion 20, a pair of seat portion 20, and a water receiving portion 40.

The cradle portion 20 is designed for resting on a support surface such as the ground. The cradle portion 20 is substantially arcuate. The cradle portion 20 is designed for rocking along an arcuate perimeter surface 23. The cradle portion includes a first end 21 and a second end 22. The cradle portion 20 is substantially hollow.

Each one of the pair of seat portions 30 is coupled to the cradle portion 20. Each of the seat portions 30 is positioned adjacent to an associated one of the first 21 and second ends 22 of the cradle portion 20. Each one of the pair of seat portions 30 is designed for supporting a posterior of a human.

The water receiving portion 40 is designed for coupling to a conventional garden hose. The water receiving portion 40 facilitates routing of water to spray a user.

The cradle portion 20 includes a first plurality of apertures 24 positioned through the first end 21 of the cradle portion 20. The first plurality of apertures 24 is designed for directing water from the water receiving portion 40 onto a user when the user rocks the cradle portion 20.

The cradle portion 20 includes a second plurality of apertures 25 positioned through the second end 22 of the cradle portion 20. The second plurality of apertures 25 is designed for directing water from the water receiving portion 40 onto a user when the user rocks the cradle portion 40.

The seat portion 30 includes a pair of handles 32. Each one of the handles 32 is positioned on an associated side of the end of the cradle portion 20. The handles 32 are positioned such that a longitudinal axis of each handle 32 is in a substantially perpendicular relationship with a longitudinal axis of the cradle portion 20. Each handle 32 is designed for grasping by a human hand. Each handle 32 facilitates holding onto the rocking and spray system 10 during use.

Each on of a plurality of foot pegs 26 is coupled to an associated side of the cradle portion 20. Each foot peg 26 is positioned such that a longitudinal axis of each foot peg 26 is in a substantially perpendicular relationship with a longitudinal axis of the cradle portion 20. Each foot peg 26 is positioned such that the longitudinal axis of each foot peg 26 is in a substantially parallel relationship with a longitudinal axis of a handle 32 coupled to the cradle portion 20. Each of the foot pegs 26 is designed for supporting a human foot. Each one of the foot pegs 26 facilitates remaining on the rocking and spray system 10 during use.

A central spray portion 27 is positioned medially on an upper surface of the cradle portion 20. The central spray portion 27 is designed for facilitating a spray of water from the water receiving portion.

In an embodiment the spray portion 27 continually provides a spray of water during use when the water receiving portion 40 is coupled to a water source via a conventional garden hose.

The cradle portion 20 is substantially translucent such that light may pass through an exterior wall of the cradle portion 20.

An illumination assembly 50 is positioned substantially within the cradle portion 20. The illumination assembly 50 provides an internal light source to illuminate exterior portions of the cradle portion 20. The illumination assembly 50 facilitates use of the rocking and spray system 10 at night.

The illumination assembly 50 further comprises at least one lamp member 52 for converting stored electrical energy into light for illuminating the cradle portion 20 and at least one battery member 54 for providing stored electrical energy to the lamp member 52.

In an embodiment the rocking and spray system 10 includes an overall length in the range of 84 inches to 96 inches.

In a further embodiment the cradle portion 20 includes a width of approximately 24 inches.

In yet a further embodiment the rocking and spray system 10 includes an overall height of approximately 30 inches.

A plurality of baffle members 60 is positioned substantially within the cradle member 20. The plurality of baffles 60 impede the flow of water through the cradle member 20 from the water receiving portion 40 such that the water only flows through the first series of apertures 23 when the cradle portion 20 is positioned with the first end 21 substantially lower that the second end 22. Similarly, the plurality of baffles 60 impede the flow of water through the cradle member 20 from the water receiving portion 40 such that the water only flows through the second series of apertures 24 when the cradle portion 20 is positioned with the second end 22 substantially lower that the first end 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rocking and spray system for entertaining children of all ages comprising:

a cradle portion adapted for resting on a support surface such as the ground, said cradle portion being substantially arcuate, said cradle portion being adapted for rocking along an arcuate perimeter surface, said cradle portion having a first end and a second end, said cradle portion being substantially hollow;

a pair of seat portions, each one of said pair of seat portions being coupled to said cradle portion, each of said seat portions being positioned adjacent to an associated one of said first and second ends of said cradle portion, each one of said pair of seat portions being adapted for supporting a posterior of a human;

a water receiving portion adapted for coupling to a conventional garden hose, said water receiving portion facilitating routing of water to spray a user; and said cradle portion being substantially translucent such that light may pass through an exterior wall of said cradle portion;

an illumination assembly positioned substantially within said cradle portion, said illumination assembly providing an internal light source to illuminate exterior portions of said cradle portion, said illumination assembly facilitating use of said rocking and spray system at night.

2. The rocking and spray system of claim 1, further comprising:

said cradle portion having a first plurality of apertures positioned through said first end of said cradle portion, said first plurality of apertures being adapted for directing water from said water receiving portion onto a user when the user rocks said cradle portion.

3. The rocking and spray system of claim 1, further comprising:

said cradle portion having a second plurality of apertures positioned through said second end of said cradle portion, said second plurality of apertures being adapted for directing water from said water receiving portion onto a user when the user rocks said cradle portion.

4. The rocking and spray system of claim 1, further comprising:

said seat portion having a pair of handles, each one of said a handles being positioned on an associated side of said end of said cradle portion, said handles being positioned such that a longitudinal axis of each handle is in a substantially perpendicular relationship with a longitudinal axis of said cradle portion, each handle being adapted for grasping by a human hand, each handle facilitating holding onto said rocking and spray system during use.

5. The rocking and spray system of claim 1, further comprising:

a plurality of foot pegs, each foot peg being coupled to an associated side of said cradle portion, each foot peg being positioned such that a longitudinal axis of each foot peg is in a substantially perpendicular relationship with a longitudinal axis of said cradle portion, each foot peg being positioned such that the longitudinal axis of each foot peg is in a substantially parallel relationship with a longitudinal axis of a handle coupled to said cradle portion; each of said foot pegs being adapted for supporting a human foot, each one of said foot pegs facilitating remaining on said rocking and spray system during use.

6. The rocking and spray system of claim 1, further comprising:

a central spray portion positioned medially on an upper surface of said cradle portion, said central spray portion being adapted for facilitating a spray of water from said water receiving portion.

7. The rocking and spray system of claim 6, wherein said spray portion continually provides a spray of water during use when said water receiving portion is coupled to a water source via a conventional garden hose.

8. The rocking and spray system of claim 1, wherein said illumination assembly further comprises:

at least one lamp member for converting stored electrical energy into light for illuminating said cradle portion;

at least one battery member for providing stored electrical energy to said lamp member.

9. The rocking and spray system of claim 1, wherein said cradle rocking and spray system having an overall length in the range of 84 inches to 96 inches.

10. The rocking and spray system of claim 1, wherein said cradle portion having a width of approximately 24 inches.

11. The rocking and spray system of claim 1, wherein said rocking and spray system having an overall height of approximately 30 inches.

12. A rocking and spray system for entertaining children of all ages comprising:

a cradle portion adapted for resting on a support surface such as the ground, said cradle portion being substantially arcuate, said cradle portion being adapted for rocking along an arcuate perimeter surface, said cradle portion having a first end and a second end, said cradle portion being substantially hollow;

a pair of seat portions, each one of said pair of seat portions being coupled to said cradle portion, each of said seat portions being positioned adjacent to an associated one of said first and second ends of said cradle portion, each one of said pair of seat portions being adapted for supporting a posterior of a human;

a water receiving portion adapted for coupling to a conventional garden hose, said water receiving portion facilitating routing of water to spray a user;

said cradle portion having a first plurality of apertures positioned through said first end of said cradle portion, said first plurality of apertures being adapted for directing water from said water receiving portion onto a user when the user rocks said cradle portion;

said cradle portion having a second plurality of apertures positioned through said second end of said cradle portion, said second plurality of apertures being adapted for directing water from said water receiving portion onto a user when the user rocks said cradle portion;

said seat portion having a pair of handles, each one of said handles being positioned on an associated side of said end of said cradle portion, said handles being positioned such that a longitudinal axis of each handle is in a substantially perpendicular relationship with a longitudinal axis of said cradle portion, each handle being adapted for grasping by a human hand, each handle facilitating holding onto said rocking and spray system during use;

a plurality of foot pegs, each foot peg being coupled to an associated side of said cradle portion, each foot peg being positioned such that a longitudinal axis of each foot peg is in a substantially perpendicular relationship with a longitudinal axis of said cradle portion, each foot peg being positioned such that the longitudinal axis of each foot peg is in a substantially parallel relationship with a longitudinal axis of a handle coupled to said cradle portion; each of said foot pegs being adapted for supporting a human foot, each one of said foot pegs facilitating remaining on said rocking and spray system during use;

a central spray portion positioned medially on an upper surface of said cradle portion, said central spray portion being adapted for facilitating a spray of water from said water receiving portion;

wherein said spray portion continually provides a spray of water during use when said water receiving portion is coupled to a water source via a conventional garden hose;

said cradle portion being substantially translucent such that light may pass through an exterior wall of said cradle portion;

an illumination assembly positioned substantially within said cradle portion, said illumination assembly providing an internal light source to illuminate exterior portions of said cradle portion, said illumination assembly facilitating use of said rocking and spray system at night;

said illumination assembly further comprises:

at least one lamp member for converting stored electrical energy into light for illuminating said cradle portion;

at least one battery member for providing stored electrical energy to said lamp member;

wherein said cradle rocking and spray system having an overall length in the range of 84 inches to 96 inches;

wherein said cradle portion having a width of approximately 24 inches; and wherein said rocking and spray system having an overall height of approximately 30 inches.

13. The rocking and spray system of claim 12, further comprising:

a plurality of baffle members positioned substantially within said cradle member, said plurality of baffles impeding the flow of water through said cradle member from said water receiving portion such that the water only flows through said first series of apertures when said cradle portion is positioned with said first end substantially lower that said second end, said plurality of baffles impeding the flow of water through said cradle member from said water receiving portion such that the water only flows through said second series of apertures when said cradle portion is positioned with said second end substantially lower that said first end.

* * * * *